US006351200B1

(12) United States Patent
Azzi et al.

(10) Patent No.: US 6,351,200 B1
(45) Date of Patent: Feb. 26, 2002

(54) DEFLECTION YOKE WITH GEOMETRY DISTORTION CORRECTION

(75) Inventors: Nacerdine Azzi, Genlis; Olivier Masson, Cuisery, both of (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/569,673

(22) Filed: May 12, 2000

Related U.S. Application Data

(62) Division of application No. 09/319,757, filed on Jun. 10, 1999, now Pat. No. 6,150,910.

(30) Foreign Application Priority Data

Dec. 20, 1996 (FR) ..... 96 15734

(51) Int. Cl.[7] ..... H01F 7/00
(52) U.S. Cl. ..... 335/213; 335/210; 313/340
(58) Field of Search ..... 335/210–214; 313/340

(56) References Cited

U.S. PATENT DOCUMENTS 4,464,643 A 8/1984 Meershoek ..... 335/213

FOREIGN PATENT DOCUMENTS

EP 0366196 5/1990 ..... H01J/9/236
EP 0425747 5/1991 ..... H01J/29/76
EP 0436998 7/1991 ..... H01J/9/236
EP 0540113 5/1993 ..... H01J/29/76
EP 0569079 11/1993 ..... H01J/29/76

*Primary Examiner*—Ramon M. Barrera
(74) *Attorney, Agent, or Firm*—Joseph S. Tripoli; Harvey D. Fried; Sammy S. Henig

(57) ABSTRACT

A video display deflection apparatus includes a vertical deflection coil. A separator is used for mounting the vertical deflection coil thereon. The separator has a funnel shaped first part conforming to a shape of a neck of the cathode ray tube and a second part forming a front portion of the separator close to the screen. A degree of flare of the first and second parts is substantially different. A saddle shaped, horizontal deflection coil is mounted on the separator for producing a deflection field to scan the electron beam along a horizontal axis of the display screen. The horizontal deflection coil includes a plurality of winding turns forming a pair of side portions, a rear end turn portion, close to an electron gun of the tube and a front end turn portion, close to the screen. At least a portion of the front end turn portion, in a radial angular position ranging between 0 and 30 degrees, is supported on the second part of said separator away from the boundary. Consequently, an effective length of the horizontal deflection coil is extended in a direction of the screen to provide north-south raster distortion correction. A magnetically permeable core cooperates with the deflection coils to form a deflection yoke free of permanent magnets upfront.

7 Claims, 7 Drawing Sheets

DEFLECTION YOKE WITH GEOMETRY DISTORTION CORRECTION

This application is a divisional of U.S. patent application Ser. No. 09/319,757, filed Jun. 10, 1999, now U.S. Pat. No. 6,150,910.

The invention relates to a deflection yoke for a color cathode ray tube (CRT) of a video display apparatus. In particular, the invention relates to a deflection yoke having a pair of horizontal deflection coils in the shape of a saddle for correcting north-south geometry distortion of the picture formed on the screen of the CRT.

BACKGROUND

A CRT for generating color pictures generally contains an electron gun emitting three coplanar beams of electrons (R, G and B electron beams), to excite on a screen a luminescent or phosphorous material of a given primary color red, green, and blue, respectively. The deflection yoke is mounted the neck of the tube for producing deflection fields created by the horizontal and vertical deflection coils or windings. A ring or core of ferromagnetic material surrounds in a conventional way the deflection coils.

The three beams generated are required to converge on the screen for avoiding a beam landing error called convergence error that would otherwise produce an error in the rendering of the colors. In order to provide convergence, it is known to use astigmatic deflection fields called self-converging. In a self-converging deflection coil, the field nonuniformity that is depicted by lines of flux generated by the horizontal deflection coil has generally pincushion shape in a portion of the coil situated in the front part, closer to the screen.

A coma error occurs because the R and B beams, penetrating the deflection zone at a small angle relative to the longitudinal axis of the tube, undergo a supplementary deflection with respect to that of the center G beam. With respect to the horizontal deflection field, coma is generally corrected by producing a barrel shape horizontal deflection field at the beam entrance region or zone of the deflection yoke, behind the aformentioned pincushion field that is used for convergence error correction.

A coma parabola distortion is manifested in a vertical line at the side of the picture by a gradual horizontal direction shift of the green image relative to the mid-point between the red and blue images as the line is followed from the center to the corner of the screen. If the shift is carried out toward the outside or side of the picture, such coma parabola error is conventionally referred to as being positive; if it is carried out toward the inside or center of picture, the coma parabola error is referred to as being negative.

A geometry distortion referred to as pincushion distortion is produced in part because of the non-spherical shape of the screen surface. The distortion of the picture, referred to as North—South at the top and bottom and East-West at the side of the picture, is stronger as the radius of curvature of the screen is greater.

When the screen has a relatively large radius of curvature greater than 1 R, such as 1.5 R or more, for example, it becomes more and more difficult to solve the beam landing errors, such as the geometry distortion, without utilizing magnetic helpers such as shunts or permanent magnets. For example, in the prior art deflection yoke of FIG. 2, permanent magnets are positioned in front of the deflection yoke to reduce North-South geometry distortions.

It is common practice to divide the deflection field into three successive action zones along the longitudinal axis of the tube: the back or rear zone closest to the electron gun, the intermediate zone and the front zone, closest to the screen. Coma error is corrected by controlling the field in the rear zone. Geometry error is corrected by controlling the field in the front zone. Convergence error is corrected in the rear and intermediate zones and is least affected in the front zone.

It may be desirable reduce the North-South geometry distortion by controlling winding distributions of deflection coils without utilizing magnetic helpers such as shunts or permanent magnets. Eliminating the shunts or permanent magnets is desirable because, disadvantageously, these additional components may produce a heating problem in the yoke related to higher horizontal frequency, particularly when the horizontal frequency is 32 kHz or 64 kHz and more. These additional components may also, undesirably, increase variations among the produced yokes in a manner to degrade error such as geometry, coma, coma parabola or convergence error corrections.

In the prior art deflection yoke of FIG. 2, a separator is composed of a main part 161 conforming to the shape of the tube on which the deflection yoke is mounted for a substantial length of the seperator. However, a front end 160 of the separator deviates away in a plane perpendicular to the Z axis from the funnel shape contour of the tube. An inside surface of front end 160 is used for supporting front end turn of the horizontal deflection coil. The circular shape of inside boundary 162 of front end 160 forms a boundary between part 160 that is perpendicular to the Z-axis and part 161 having the flare shape that conforms to the conical shape of the tube funnel. The surface of the wall of the flared front end 160 of the separator is flat and perpendicular to the main Z axis. During the winding process of the coil, retractable pins are inserted perpendicular to the XY plane to form corners in the winding. In the prior art yoke of FIG. 2, pins are placed substantially at boundary circle 162 of front end 160 of the separator, between parts 160 and 161.

It may be desirable to utilize front end 160 for increasing the effective length of the coil. Increasing the effective length of the coil facilitates shifting the deflection center of the horizontal deflection coil with respect to that of the vertical deflection coil.

In accordance with an inventive feature, the corners in the winding produced by the pins are placed remote from the boundary circle. Thereby, advantageously, a substantial portion of the coil is extended in the front end 160. The result is that the effective length of the coil is increased in a manner to reduce North-south geometry distortion.

SUMMARY

A video display deflection apparatus, embodying an inventive feature, includes first and second deflection coils. A separator is used for mounting the first and second deflection coil thereon. The separator has a funnel shaped first part conforming to a shape of a neck of the cathode ray tube and a second part forming a front portion of the separator close to the screen. A degree of flare of said first and second parts is substantially different. The second deflection coil includes a plurality of winding turns forming a pair of side portions, a rear end turn portion, close to an electron gun ot the tube and a front end turn portion, close to the screen. At least a portion of the front end turn portion in a radial angular position ranging between 0 and 30 degrees is supported on the second part of the separator away from the boundary in a manner to extend an effective length of the second deflection coil in a direction of the screen to provide raster distortion correction.

DESCRIPTION OF THE PREFERRED EMBODIMENTS

Figure 1:
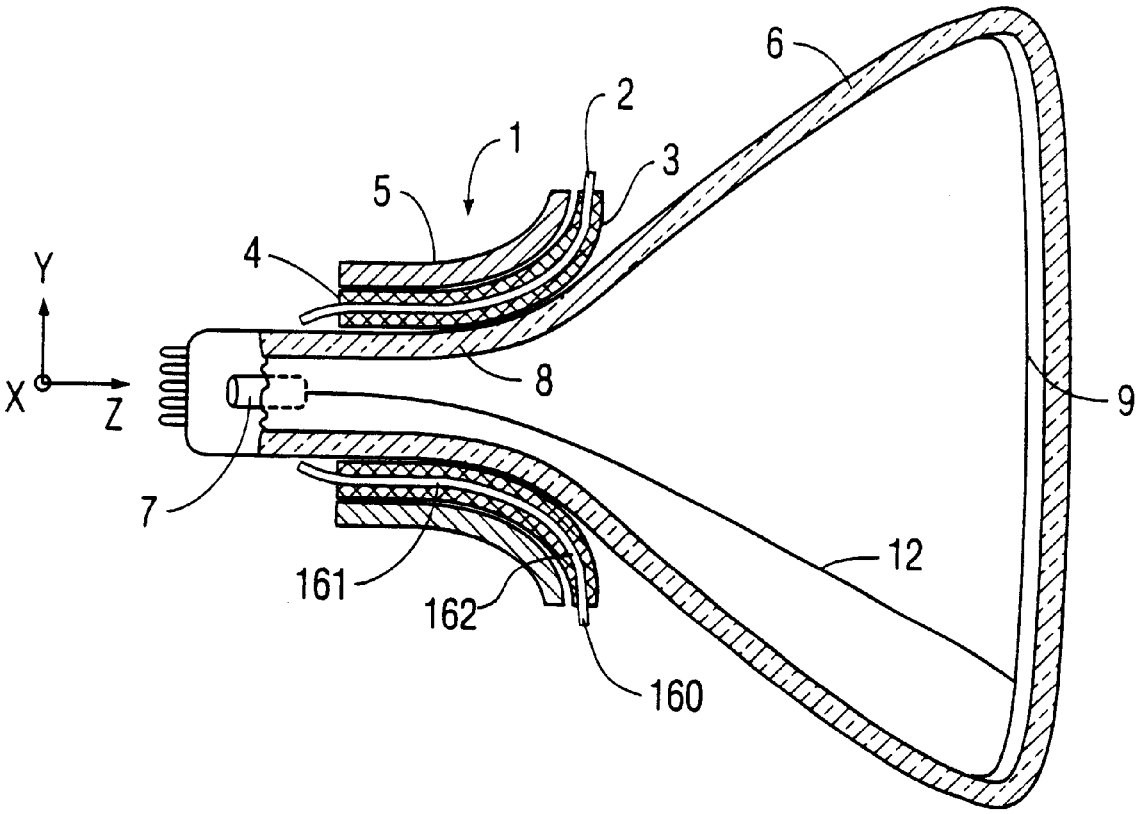
FIG. 1 illustrates a deflection yoke, according to an inventive arrangement, mounted on a cathode ray tube.
Figure 2:
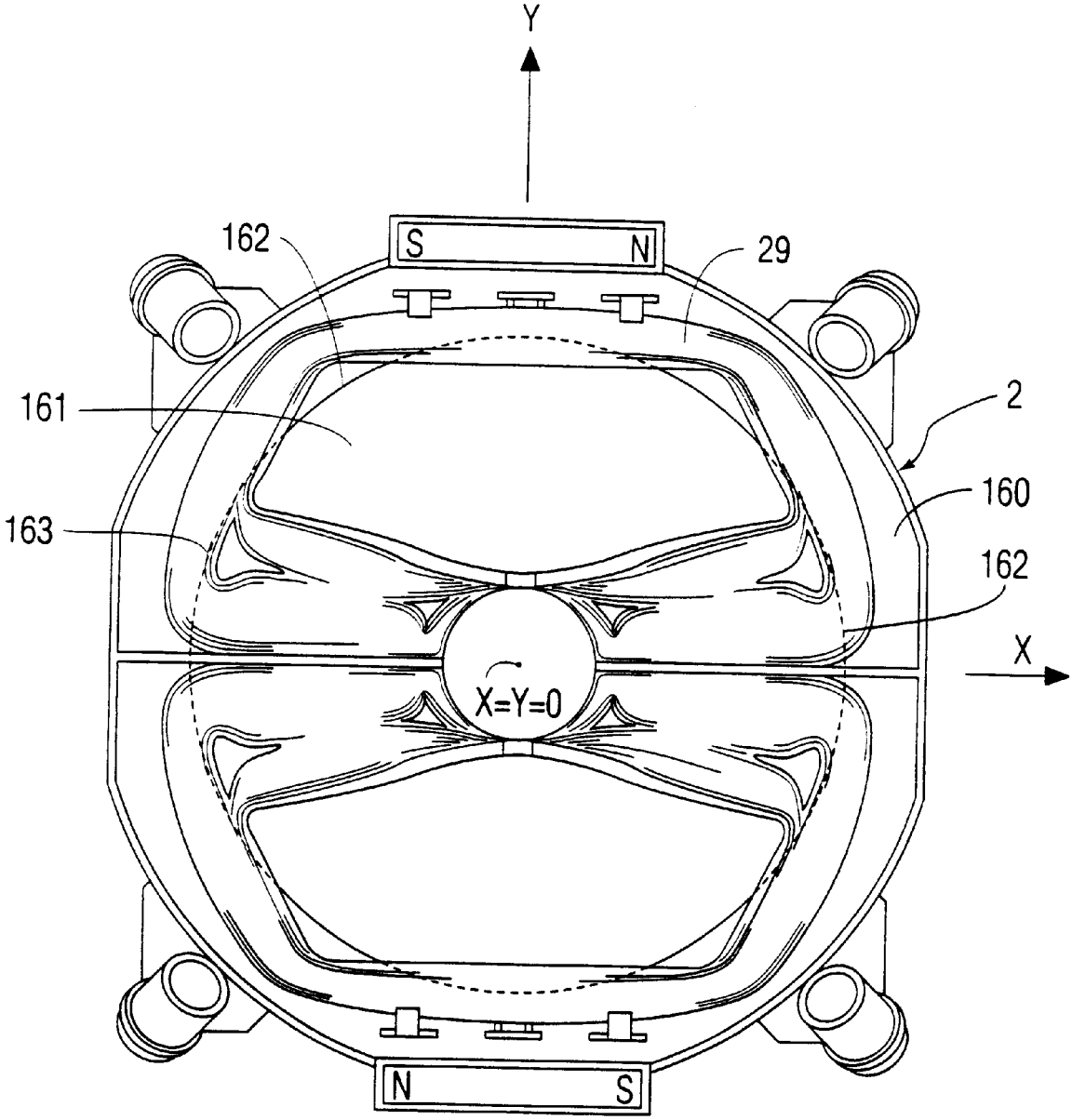
FIG. 2 PRIOR ART
FIG. 2 illustrates a frontal, exploded view of a deflection yoke according to the prior art.

As illustrated in FIG. 1, a self-converging color display device includes a cathode ray tube (CRT) having an evacuated glass envelope 6 and an arrangement of luminescent or phosphorous elements representing the three primary colors R, G and B arranged at one of the extremities of the envelope forming a display screen 9. Electron guns 7 arranged at a second extremity of the envelope. The set of electron guns 7 is arranged so as to produce three electron beams 12 aligned horizontally in order to excite corresponding luminescent color elements. The electron beams sweep the surface of the screen by the operation of deflection yoke 1 mounted on a neck 8 of the tube. Deflection yoke 1 includes a pair of horizontal deflection coils 3, a pair of vertical deflection coils 4, isolated from each other by a separator 2, and a core of ferromagnetic material 5 provided to enhance the field at the beam paths.

Figure 4A:
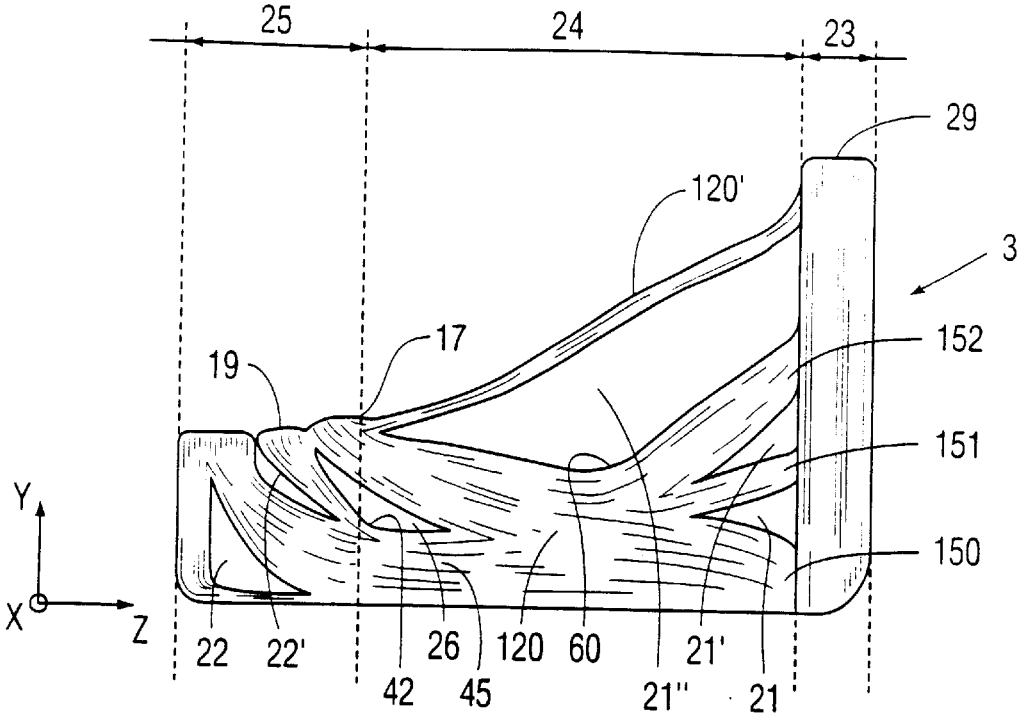
FIGS. 4*a,* 4*b* and 4*c* represent a side view, a top view and a front view, respectively, of a coil according to an inventive arrangement.

FIGS. 4*a,* 4*b* and 4*c* illustrate, respectively, the side, top and front views of one of the pair of horizontal coils or windings 3 having a saddle shape in accordance with an aspect of the invention. Each winding turn is formed by a loop of a conductor wire. Each of the pair of horizontal deflection coils 3 has a rear end turn portion 19 of FIGS. 4*a* and 4*b,* near the electron gun 7, and extending along the longitudinal or Z axis. A front end turn portion 29 disposed close to display screen 9 is curved away from the Z axis in a direction generally transverse to the Z axis. Each of core 5 and separator 2 may, advantageously, be fabricated in the form of a single piece rather than being assembled from two separate pieces.

Figure 4B:
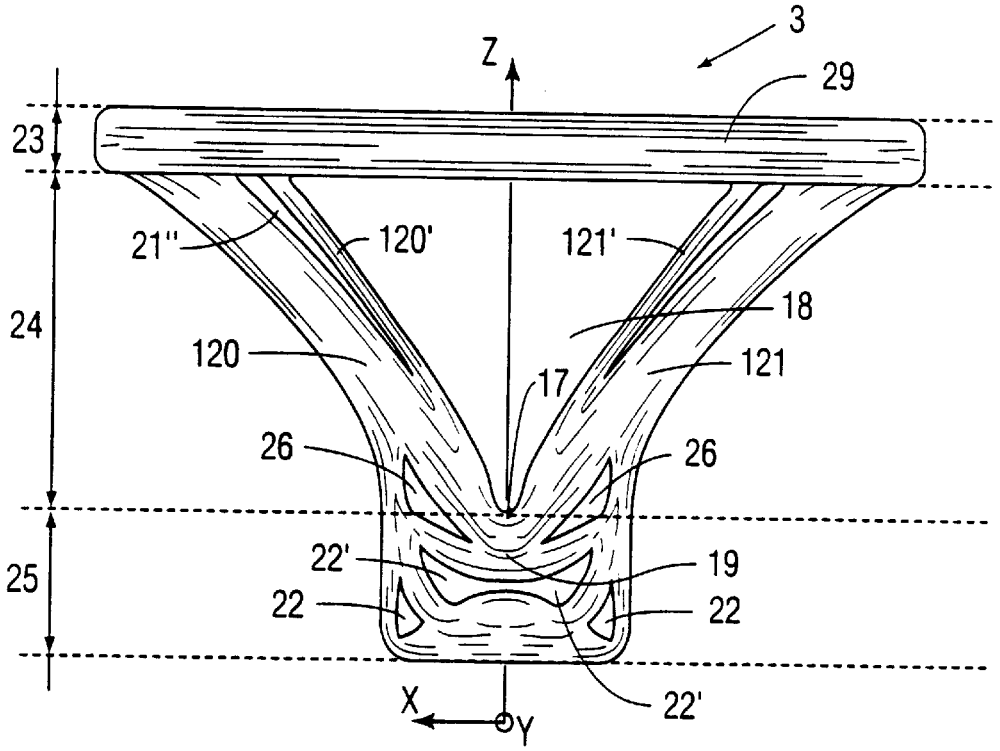
Figure 4C:
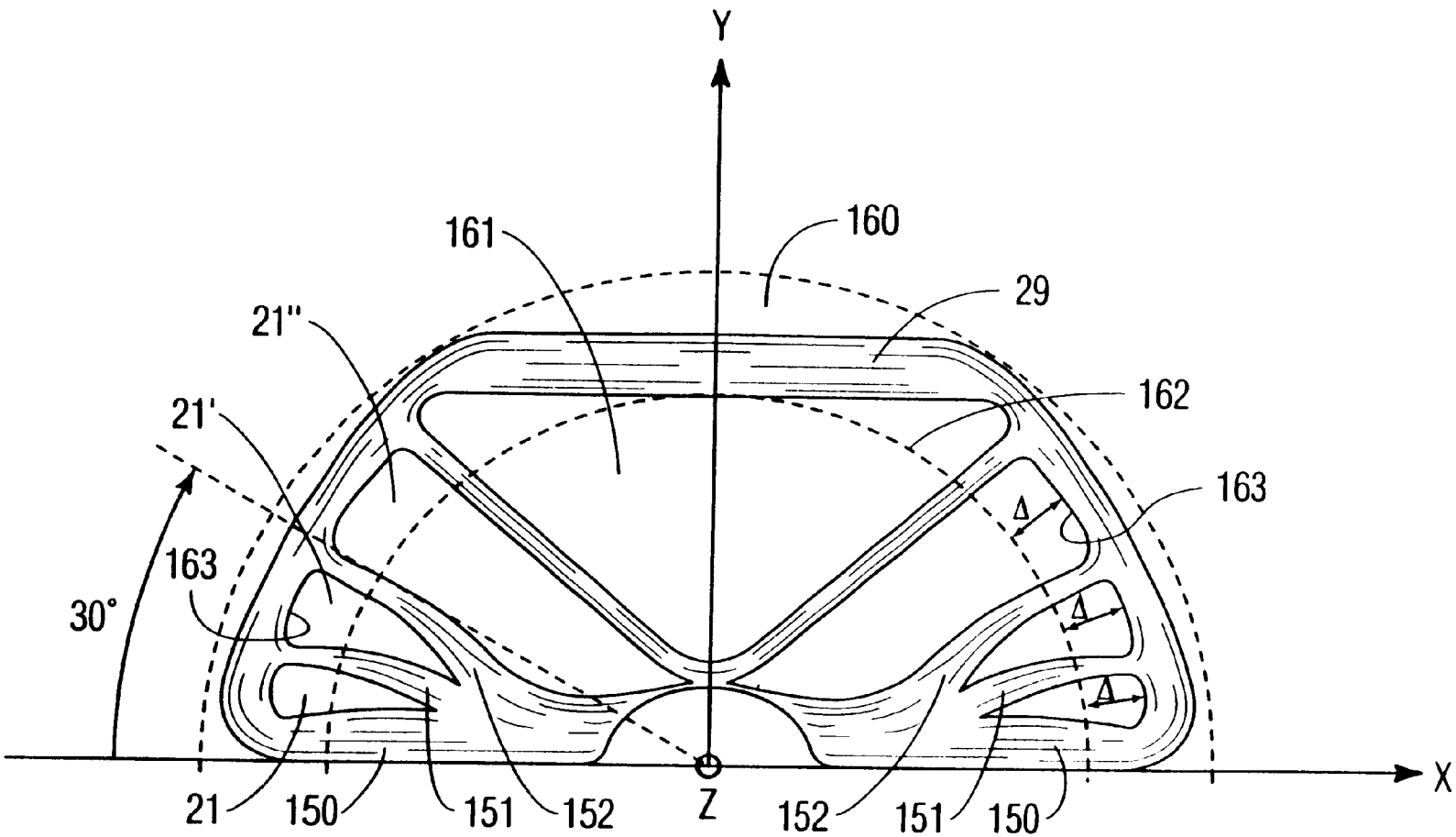

The conductor wires of front end turn portion 29 of the saddle coil 3 of FIGS. 4*a*–4*c* are connected to rear end turn portion 19 by side wire bundles 120, 120', forming a side winding section, along the Z axis, on the one side of the X axis and by side wire bundles 121, 121', on the other side of the X axis. The portions of side wire bundles 120, 120' and 121, 121' situated in the deflection coil deflection magnetic field beam exit region 23 form front spaces 21, 21' and 21" of FIG. 4*a.* The front spaces 21, 21' and 21" affect or modify the current distribution harmonics so as to correct, for example, the geometric distortions of the image formed on the screen such as the north-south distortion. Likewise, the portions of side wire bundles 120, 120' and 121, 121' situated in the entrance region of deflection coil 3 produce back spaces 22 and 22'. Spaces 22 and 22' have winding distributions selected for correcting the horizontal coma errors. End turn portions 19 and 29 as well as side wire bundles 120' and 121' define a main winding window 18.

The saddle coil of FIGS. 4*a*–4*c* may be wound with a copper wire of small dimensions covered with an electrical insulation and with a thermosetting glue. The winding is carried out in a winding machine which winds the saddle coil essentially according to its final shape and introduces spaces 21, 21', 21", 22, 22' of FIGS. 4*a*–4*c* during the winding process. The shapes and placements of these spaces are determined by retractable pins in the winding head which limit the shapes which these spaces may assume. Each pin produces a corresponding winding corner in the vicinity of the pin to change the direction of the wire.

After the winding, each saddle coil is kept in a mold and a pressure is applied to it in order to obtain the required mechanical dimensions. A current passes through the wire in order to soften the thermosetting glue which is then cooled again in order to glue the wires to each other and to form a saddle coil which is self supporting.

The region along the longitudinal Z-axis of end turn portion 29 defines a beam exit zone or region 23 of coil 3. The region along the longitudinal Z-axis of window 18 defines an intermediate zone or region 24 and extends, at one extreme, from the Z-axis coordinate of a corner portion 17 in which side wire bundles 120' and 121' are joined. The other extreme of window 18 is defined by portion 29. The zone of the coil situated in rear behind window 18 including rear end turn 19 is referred to as the beam entrance region or zone 25.

Coma error are corrected mainly in the rear or entrance zone 25. Geometry errors such as East—West and North South distortions are mainly corrected at or near exit zone 23. Convergence error is least affected in the exit zone 23 and is mainly corrected in intermediate zone 24 and entrance zone 25.

Figure 3:
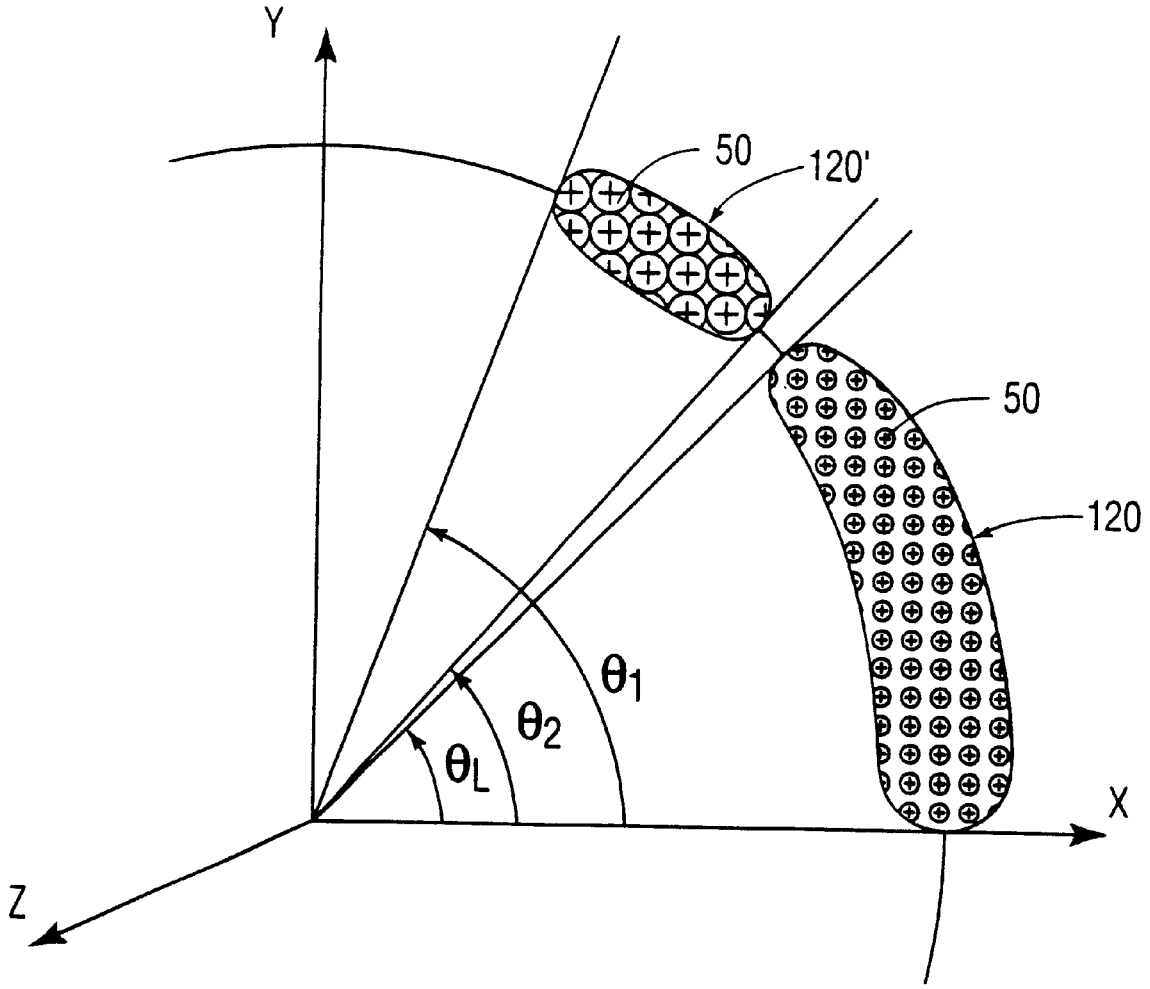
FIG. 3 shows a cross section of a saddle coil according to an inventive arrangement formed in the intermediate zone of the coil.

FIG. 3 is a cross sectional view of saddle line coil 3 in a plane parallel to XY in intermediate zone 24. For symmetry consideration, the cross section of only one half of the coil is represented. This half coil includes bundles 120, 120' of conductors 50. The position of each conductor is identified by its radial angular position θ. The condutor wires of group 120 are arranged between zero degrees and $\theta_L$ while those of the group 120' are arranged between θ1 and θ2.

Because of symmetry consideration of the windings, the Fourier series expansion of the ampere turn density N(θ) of a coil is written:

$$N(\theta)=A1\cdot\cos(\theta)+A3\cdot\cos(3\theta)+A5\cdot\cos(5\theta)+\ldots+AK\cdot\cos(K\theta)+ \quad \text{(EQ1)}$$

$$\text{with: } AK=(4/\pi)\cdot\int_0^{\pi/2}N(\theta)\cdot\cos(K\theta)\cdot d\theta \quad \text{(EQ2)}$$

The magnetic field assumes the expression:

$$H=A1/R+(A3/R^3)\cdot(X^2-Y^2)+(A5/R^5)\cdot(X^4-6X^2\cdot Y^2+Y^4)+ \quad \text{(EQ3)}$$

where R is the radius of the magnetic circuit of the ferrite core surrounding the deflection coils. The term A1/R represents the zero order coefficient or fundamental field component of the field distribution function, the term $(A3/R^3)\cdot(X^2-Y^2)$ represents the second order coefficient of the field distribution function in a point of coordinates X and Y and is related to the third harmonic of the winding distribution. The term $(A5/R^5)(X^4-6X^2\cdot Y^2+Y^4)$ represents the fourth order coefficient of this field or fifth harmonic, etc.

A positive term A3 corresponds to a second order coefficient of the positive field on the axis that produces pincushion shaped field. In the case where the current circulates in the same direction in all of the conducting wires, N(θ) is conventionally positive, and the term A3 is positive if the wires are arranged between θ=zero degrees and θ=30 degrees. This is so because cos(3θ) is positive. By arranging the wires in the angular range previously defined it is possible to introduce locally a significant positive second order coefficient of the field as well as a positive fourth order coefficient of the field that is positive overall.

In order to maintain the convergence of the electron beams coming from an in-line gun, it is known to make the second order coefficient of the line deflection field positive in the intermediate zone 24 of FIGS. 4*a* and 4*b*. For this purpose, a majority of wires of the side wire bundles 120, in at least one part of the intermediate zone 24, is kept in a radial angular position ranging between 0 degrees and 30 degrees. However, because this method of controlling the convergence of the beams introduces a strong coma parabola error, the coma parabola error has to be corrected.

Coma errors are corrected by the introduction of spaces 22, 22' in the zone 25 where the end turn section 19 is situated. An additional space 26, opening into both zones 24 and 25 permits adjustment of the residual errors of coma and coma parabola. Thus, convergence and coma errors are reduced to acceptable values by a coil structure such as illustrated by FIGS. 4*a*, 4*b*, and 4*c* where the coma errors are adjusted by the spaces 22, 22', 26 and the convergence of the beams by the spaces 26 and 21".

The arrangement of bundles of wires in the front portion of the intermediate region near the front end turn section 29 contributes to the reduction of the north—south geometry distortion of the image created on the screen. The bundles 150, 151, 152 of FIG. 4*a* contain together the majority of the coil wires and are arranged in a radial angular potition in the XY plane, ranging between 0 and 30 degrees.

As illustrated by FIG. 1, the separator is composed of a funnel shaped main part 161 conforming to the shape of the tube on which the deflection yoke is mounted for a substantial length of the separator. In addition, a front end 160 of the separator forms a plane perpendicular to the Z axis that extends in the perpendicular plane XY away from the funnel shape contour of the tube. An inside surface of front end 160 is used for supporting front end turn 29 of the horizontal deflection coil. The circular shape of inside periphery or boundary 162 of front end 160 forms a boundary between part 160, that is perpendicular to the Z- axis, and part 161 having the flare shape that conforms to the conical shape of the tube funnel. Inside boundary 162 has a half circle shape in each half of the separator. During the winding process of the coil, retractable pins are inserted perpendicular to the XY plane in the zone where the side section bundles are connected to the end turn 29.

In carrying out an inventive feature, corners in the winding produce by the pins are placed further from boundary half-circle 162 of front end 160 of FIG. 4*c* and main part 161 of the separator. Residual north-south geometry errors are reduced to acceptable values by placing the internal periphery 163 of end turn 29 further from boundary half-circle 162. As indicated before, boundary half-circle 162 separates between the main body 161 of the separator and its front end 160.

Advantageously, the shift in the position of the corners in the winding produced by placing the pins on front end 160 and away from boundary half circle 162 extends in the zone of action the effective length of the horizontal deflection field toward the front of the tube and provides further correction of the north-south geometry of the picture produced by this type of field.

Moreover, the shift in the position of the corners in the winding produced by placing the pins on front end 160 and away from boundary half circle 162 increases the distance between the horizontal and vertical deflection centers. As explained by N. Azzi in a paper presented at the Society of Information Display (SID) conference in 1995, entitled "Design of a North-South pin-coma free 108 degree self-converging yoke for CRTs with super flat face plate," the increase of the distance between the deflection centers permits a better control of the north-south geometry of the picture.

In a preferential mode of implementation of the invention, the deflection yoke is mounted on a tube of the type A68SF having a screen of the aspherical type whose horizontal edges have a radius of curvature on the order of 3.5 R. The separator has front end 160 in the shape of a circular ring forming a surface supporting the end turn 29. Front end 160 is flat and parallel to the XY plane. The front end turn 29 extends in a direction perpendicular to the Z axis, which offers the advantage of keeping short the size of the deflection yoke along the Z axis direction. Furthermore, easier manufacture of the winding in the mold is facilitated because, during the winding, the retractable pins are inserted perpendicularly to the surface of the mold; thereby, a better retention of the wires during said winding is obtained.

Figure 5A:
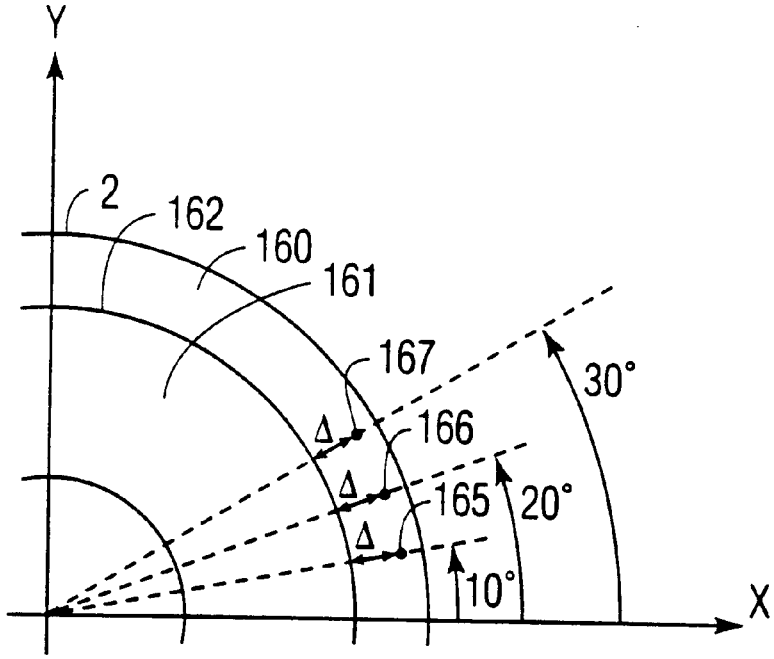
FIGS. 5*a* and 5*b* show the position of the winding pins in front of the saddle coil of FIGS. 4*a,* 4*b* and 4*c* relative to the separator.
Figure 5B:
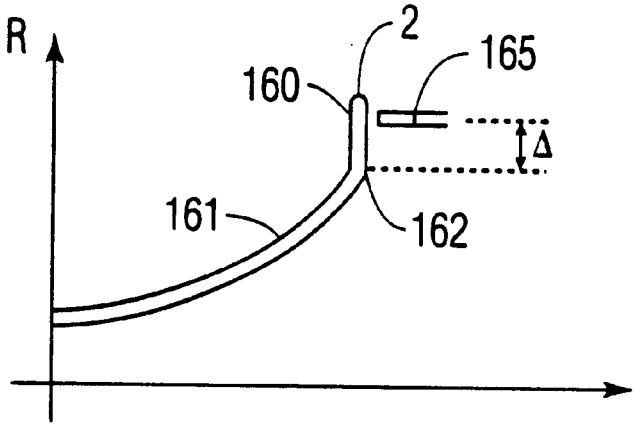

FIG. 5*a* illustrates in a front view the positions of front pins at locations 165, 166, and 167 with respect to the separator. FIG. 5*b* illustrates in a radial cross section, the radial positions of front pins at location 165. The pins at locations 165, 166, and 167 of FIG. 5*a* are inserted during the winding process so as to create the bundles of wires 150, 151, and 152, respectively. Each pin produces a corresponding winding corner in the winding in the region that makes contact with the pin. The bundle 150 contains 57% of the total number of wires and bundles 151 and 152 contain 11% and 26%, respectively. The pins are arranged in radial annular positions in the XY plane, equal respectively to 10, 20, and 30 degrees, respectively. The pins are displaced or shifted relative to the boundary half circle 162, on the ring 160. The boundary half circle 162 is essentially circular with a radius equal to 54.5 mm. The position of the pin, hence that of the winding corner, is placed away from boundary half circle 162 by a distance from the center of the circular cross section of the pin that is the same for each of the pins. That distance is equal to a value of delta=4 mm. Thus, each winding corner is disposed away from boundary half circle 162.

Various combinations have been considered that include shifting only the pin at 10 degree, shifting only the 20 degree pin, shifting only the 30 degree pin, and then shifting the pins two at a time. It has been shown that shifting the pin at location 167 situated approximately at 30 degrees was the one which offered the most sensitivity to the control of the external north-south geometry error relative to the horizontal edges of the picture. In the case of the deflection yoke for the tube A68SF, a 4 mm shift of the location of the pin at location 167, by itself, causes, advantageously, an external north-south pincushion deviation of −1.11% relative to a reference situation of 0%. The reference situation is obtained when the pins at locations 165 through 167 are not shifted and are situated on the edge or boundary half circle 162. Advantageously, the improvement in external north-south pincushion deviation is obtained without degrading the convergence parameters. A deviation of −1% is desirable because it provides a pincushion shape pattern on the screen. A pincushion shape pattern of −1% is perceived to a viewer at a distance from the screen equal to five times the height of the picture as being free of geometry distortion.

The radial shift in positions chosen for the three pins at locations 165 through 167 of 4 mm simplifies the manufacture of the coils without this structure being limiting. A finer north-south geometry control may be selected, if necessary, as a function of the size and the flatness of the screen, by shifting the front pins by different amounts relative to the edge boundary half circle 162.

This configuration results in an outside pincushion deviation of −1.06% and an inside pincushion deviation, measured at half distance between the horizontal edges and the center of the screen, of −0.40%. These values are acceptable without having to employ auxiliary field shapers since the internal and external north-south geometry deviations remain pincushioned shaped. The ideal values being for the outside pincushion shape on the order of −1% and on the order of −0.4% to −0.8% for the inside pincushion shape.

Figure 6:
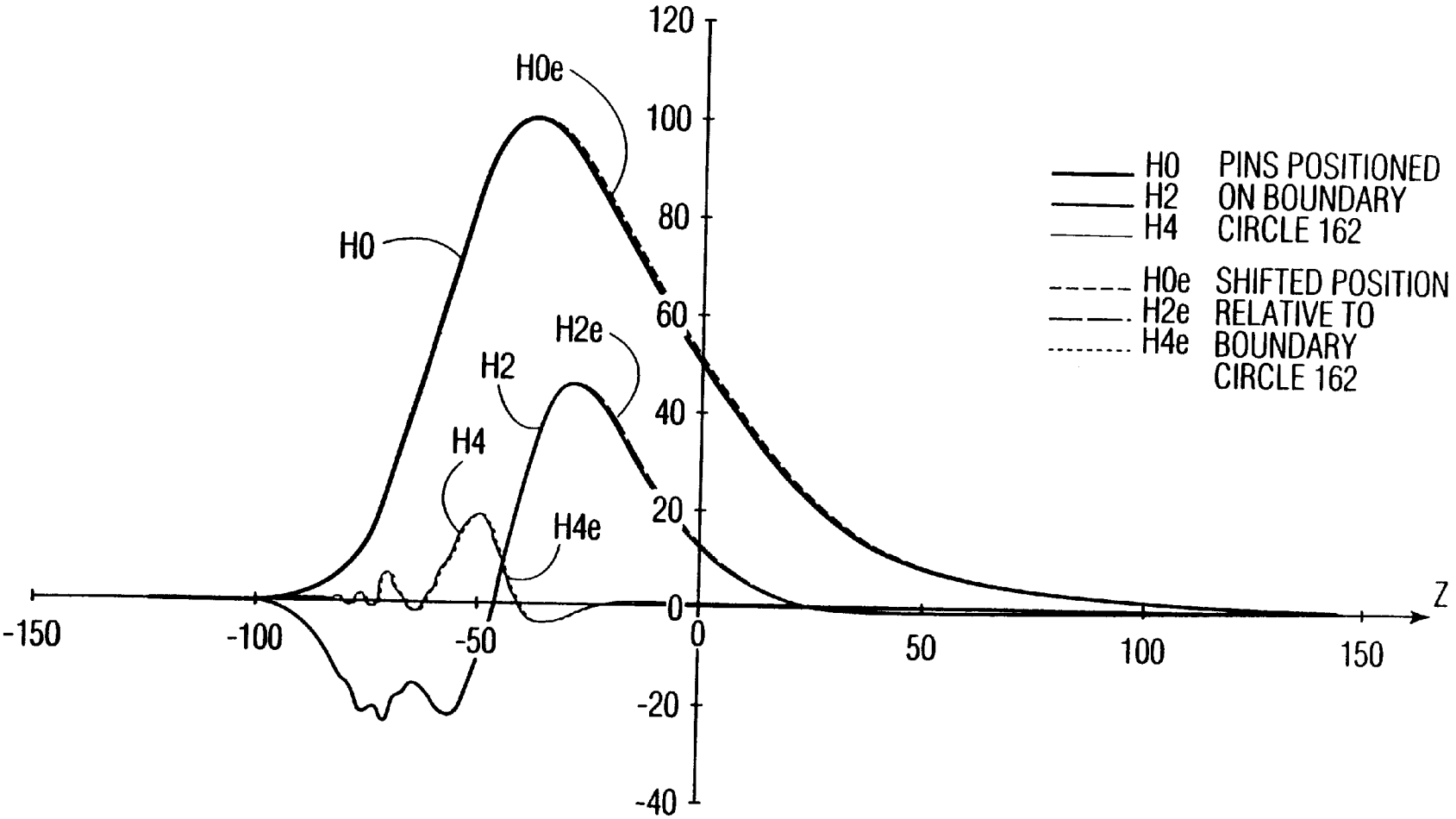
FIG. 6 shows the variation, along the main axis Z of the tube, of the horizontal deflection field distribution function coefficients generated by a coil according to an inventive arrangement and the influence of the coil extension in the front end turn of the XY plane.

FIG. 6 shows the variation of the zero and higher order coefficients of the field distribution function of the horizontal deflection field. In particular, FIG. 6 shows a slight shift toward the front of the zone of action of the zero and second order coefficients, H0 and H2. The following values, calculated from the curves of FIG. 6 show this shift toward the front:

| | Pins at location 162 | Shifted pins |
|---|---|---|
| HO integral | 261.699 | 262.869 |
| Field center of gravity | Z = −22.568 mm | Z = −22.304 mm. |
| Effective field length | 101.021 mm | 101.616 mm |

Although the differences in value between the two structures appear to be small, they are sufficient to provide the desired geometry correction. The sensitivity of the device to the displacement of the deflection center is more significant when the faceplate of the tube is flatter.

The foregoing example is not limiting. According to a mode of implementation not represented, the flared front end has an internal wall of revolution whose flaring is not perpendicularly to the Z axis but tilted toward the front of the tube, with a surface for example of truncated conical shape. This arrangement makes it possible to increase the effect generated by the shift of the pins toward the outside but likewise increases the influence on the other parameters such as convergence and coma, making the residual geometry error control less dependent upon these latter parameters.

Likewise, the number of pins, and thus the number of wire bundles formed in the 0 to 30 degree radial opening, depends upon the dimension of the screen and its flatness and thus may be greater or less than three.

Finally, this principle of controlling the residual errors of geometry may be in the same way used to control the east-west geometry and can thus be used for the design of vertical deflection coils.

What is claimed is:

1. A video display deflection apparatus, comprising:

a vertical deflection coil for producing a deflection field to scan an electron beam along a first axis of a display screen of a cathode ray tube;

a saddle shaped horizontal deflection coil for producing a deflection field to scan said electron beam along a second axis of said display screen of said cathode ray tube;

a separator for mounting said vertical and horizontal deflection coils thereon, said separator having a funnel shaped first part conforming to a shape of a neck of said cathode ray tube and a second part forming a front portion of said separator close to said screen, said first and second parts having substantially different degrees of flare, said horizontal deflection coil including a plurality of winding turns forming a pair of side portions and a front end turn portion, close to said screen, such that a winding corner is formed between one of said side portions and said front end turn portion within a radial angular position ranging between 0 and 30 degrees, said winding corner being disposed on said second part of said separator away from a boundary between said first and second parts in a manner to extend an effective length of said horizontal deflection coil in a direction of said screen to provide raster distortion correction; and a magnetically permeable core for cooperating with said vertical and horizontal deflection coils to form a deflection yoke free of permanent magnets.

2. A video display deflection apparatus according to claim 1 wherein said front end turn portion within said 0 and 30 degree range is supported on a surface of said second part of said separator and wherein said supporting second part is perpendicular to a longitudinal axis of said tube.

3. A video display deflection apparatus according to claim 1 wherein a majority of the wires that are in a front part of said side portions are situated in said angular position ranging between 0 and 30 degrees.

4. A video display deflection apparatus according to claim 1 wherein said horizontal deflection coil is formed as a unit outside said separator and is assembled after being formed with said separator to form said deflection yoke.

5. A video display deflection apparatus according to claim 1 wherein said horizontal deflection coil is formed in a winding machine using retractable pins that determine a distance away from said boundary of said winding corner.

6. A video display deflection apparatus according to claim 1 wherein said effective length of said horizontal deflection coil is extended in said direction of said screen to provide north-south raster distortion correction.

7. A video display deflection apparatus according to claim 1 wherein said deflection yoke is free of permanent magnets in a beam exit region.

* * * * *